US010711403B2

(12) United States Patent
Heiskanen et al.

(10) Patent No.: US 10,711,403 B2
(45) Date of Patent: Jul. 14, 2020

(54) SHAPED TRAY OR PLATE OF FIBROUS MATERIAL AND A METHOD OF MANUFACTURING THE SAME

(71) Applicant: Stora Enso OYJ, Helsinki (FI)

(72) Inventors: Isto Heiskanen, Imatra (FI); Jari Rasanen, Imatra (FI)

(73) Assignee: Stora Enso OYJ, Helsinki (FI)

( * ) Notice: Subject to any disclaimer, the term of this patent is extended or adjusted under 35 U.S.C. 154(b) by 24 days.

(21) Appl. No.: 15/737,000

(22) PCT Filed: Jun. 29, 2016

(86) PCT No.: PCT/IB2016/053867
§ 371 (c)(1),
(2) Date: Dec. 15, 2017

(87) PCT Pub. No.: WO2017/006216
PCT Pub. Date: Jan. 12, 2017

(65) Prior Publication Data

US 2018/0171560 A1 Jun. 21, 2018

(30) Foreign Application Priority Data

Jul. 7, 2015 (SE) ..... 1550985

(51) Int. Cl.

| | |
|---|---|
| ***D21H 27/38*** | (2006.01) |
| ***D21H 21/56*** | (2006.01) |
| ***D21F 11/00*** | (2006.01) |
| ***D21H 11/02*** | (2006.01) |
| ***D21H 11/14*** | (2006.01) |
| ***D21H 27/30*** | (2006.01) |
| ***B65D 1/34*** | (2006.01) |
| ***D21J 3/12*** | (2006.01) |
| ***D21J 7/00*** | (2006.01) |

(52) U.S. Cl.
CPC ..... *D21H 27/38* (2013.01); *D21F 11/002* (2013.01); *D21H 11/02* (2013.01); *D21H 11/14* (2013.01); *D21H 21/56* (2013.01); *D21H 27/30* (2013.01); *B65D 1/34* (2013.01); *D21J 3/12* (2013.01); *D21J 7/00* (2013.01)

(58) Field of Classification Search
CPC ..... D21H 27/30; D21H 11/02; D21H 21/22; D21H 21/56; D21H 11/14; D21H 27/38; B32B 37/144; B32B 5/02; B32B 5/14; B32B 5/18; B32B 5/26; B32B 21/02; B32B 29/00; B32B 29/06; B32B 21/13; D21F 11/002; D21J 3/12; D21J 7/00
See application file for complete search history.

(56) References Cited

U.S. PATENT DOCUMENTS

| | | | | |
|---|---|---|---|---|
| 3,716,449 | A * | 2/1973 | Gatward | D21F 11/002 162/101 |
| 5,154,982 | A * | 10/1992 | Cessna | B65D 65/466 428/537.5 |
| 5,709,827 | A * | 1/1998 | Andersen | B01F 3/1214 264/102 |
| 6,221,212 | B1 * | 4/2001 | Sjostrom | D21H 27/38 162/125 |
| 6,379,497 | B1 * | 4/2002 | Sandstrom | B65D 1/265 162/123 |
| 2001/0038893 | A1 | 11/2001 | Mohan et al. | |
| 2003/0228447 | A1 * | 12/2003 | Letzelter | D21H 19/66 428/172 |
| 2007/0224149 | A1 | 9/2007 | Suzuki et al. | |
| 2009/0194244 | A1 | 8/2009 | Harper et al. | |
| 2010/0059190 | A1 * | 3/2010 | Katajamaki | D21D 5/02 162/129 |
| 2015/0114581 | A1 * | 4/2015 | Kinnunen | B32B 5/26 162/125 |
| 2015/0284911 | A1 * | 10/2015 | Juvonen | D21H 27/30 442/158 |
| 2016/0186383 | A1 * | 6/2016 | Jannari | D21H 27/30 162/101 |
| 2017/0107340 | A1 * | 4/2017 | Kritzinger | B29B 15/00 |
| 2017/0120556 | A1 * | 5/2017 | Nyman | B32B 5/18 |
| 2017/0306561 | A1 * | 10/2017 | Nordstrom | D21F 11/002 |
| 2018/0171560 | A1 * | 6/2018 | Heiskanen | D21H 27/30 |
| 2018/0305098 | A1 * | 10/2018 | Nyman | B32B 5/02 |
| 2019/0063004 | A1 * | 2/2019 | Barnholtz | D21H 25/005 |
| 2019/0264394 | A1 * | 8/2019 | Backfolk | D21H 21/06 |
| 2019/0301101 | A1 * | 10/2019 | Zhang | D21H 17/66 |
| 2019/0322428 | A1 * | 10/2019 | Lindstedt | C09D 7/61 |

FOREIGN PATENT DOCUMENTS

| | | | | |
|---|---|---|---|---|
| CA | 2597267 C * | 8/2016 | | D21H 27/38 |
| CN | 102369324 | 3/2012 | | |

(Continued)

OTHER PUBLICATIONS

Gary Smook, "Handbook for Pulp & paper Technologists," Angus Wilde Publications, Seconnd Edition, pp. 13-15. (Year: 1992).*

(Continued)

*Primary Examiner* — Jose A Fortuna
(74) *Attorney, Agent, or Firm* — Greer, Burns & Crain Ltd.

(57) ABSTRACT

The invention relates to a method of manufacturing a shaped tray or plate of fibrous material. The method comprises the steps of (i) providing a fibrous pulp, in which the fibres substantially consist of at least 85 wt-% of softwood fibres having an average fibre length of at least 2.0 mm and at most 15 wt-% of broke having a fibre length of about 0.05 mm to 1.0 mm, (ii) turning the pulp into a foamed suspension, (iii) supplying the foamed suspension from a headbox to a forming fabric of a board machine to form a fibrous web, (iv) drying the web to obtain a dried web having a compressibility in the thickness direction of at least 20%, and (v) including the web as a layer in a board, which is turned to said tray or plate by thermopressing or deep-drawing. The invention even covers shaped trays and plates produced by use of the method.

12 Claims, No Drawings

(56) References Cited

FOREIGN PATENT DOCUMENTS

| | | | | | |
|---|---|---|---|---|---|
| EP | 0481746 | A1 | * | 4/1992 | ..... C02F 11/12 |
| EP | 0511185 | A1 | * | 10/1992 | ..... D21F 11/04 |
| EP | 1160379 | A2 | | 12/2001 | |
| GB | 1397378 | A | * | 6/1975 | ..... D21F 11/002 |
| JP | 2007262145 | A | | 10/2007 | |
| WO | WO-0050695 | A1 | * | 8/2000 | ..... D21D 5/02 |
| WO | 2013160553 | A1 | | 10/2013 | |
| WO | 2013160564 | A1 | | 10/2013 | |
| WO | WO-2013160553 | A1 | * | 10/2013 | ..... B32B 7/02 |
| WO | WO-2014080084 | A1 | * | 5/2014 | ..... D21H 27/30 |
| WO | WO-2014202841 | A1 | * | 12/2014 | ..... D21H 27/30 |
| WO | 2015036659 | A1 | | 3/2015 | |
| WO | WO-2015052382 | A1 | * | 4/2015 | ..... B29C 51/12 |
| WO | 2015066806 | A1 | | 5/2015 | |

OTHER PUBLICATIONS

International Search Report for PCT/IB2016/053867, dated Sep. 20, 2016.

* cited by examiner

SHAPED TRAY OR PLATE OF FIBROUS MATERIAL AND A METHOD OF MANUFACTURING THE SAME

This application is a U.S. National Stage under 35 U.S.C. § 371 of International Application No. PCT/IB2016/053867, filed Jun. 29, 2016, which claims priority to Swedish patent application No. 1550985-4, filed Jul. 7, 2015.

The invention relates to a method of manufacturing a shaped tray or plate of fibrous material. The invention even relates to a shaped tray or plate of fibrous material manufactured by use of the method according to the invention.

BACKGROUND OF THE INVENTION

Three-dimensional articles such as trays and plates are manufactured from two-dimensional sheet of paperboard or cardboard by thermopressing or deep-drawing. In order to adapt to the shaping operation the board is forced to folds or wrinkles, appearing as score lines located at the corners of a rectangular tray, or are divided along the periphery if the tray or plate has a circular or oval shape. Such articles are used for packaging of food or as disposable tableware.

A typical packaging board has a triple-layer structure, in which a middle layer of chemi-thermomechanical pulp (CTMP) is sandwiched between two outer layers of chemical pulp. As the board sheet is shaped into a three-dimensional configuration, the highest stress is subjected to the spots which are forced into folds or wrinkles. The resulting problem is that due to its stiffness and limited stretching ability the board sheet risks cracking at the spots of maximal stress.

A known remedy to the cracking problem is increasing the bulk of the fibrous sheet material. EP 1160379 B1 describes a press-moldable mono- or multilayer base paper for packing containers, which may comprise an intermediate low-density (high bulk) layer between two outer high-density layers. To achieve the increased bulk the reference teaches addition of heat-expanding microcapsules as a foaming agent to the pulp slurry used for making the low-density layer. As the base paper is passed through hot water the foaming agent will cause foaming as the volatile expanding agent is released, and the foamed structure of reduced density is preserved as the base paper is dried. Compressibility of the low-density layer of the base paper in the thickness direction is 10% or more, bringing about improved moldability and reduced cracking.

Another foaming technique aimed at increasing the bulk of a fibrous sheet is foam forming, in which the pulp is turned into a foamed suspension as it is fed from a headbox to a forming fabric of a paper or board machine. Characteristic for foam forming is that the bulk is higher but the tensile index is lower. A bulkier structure is more porous, which brings about the lower tensile index. Foam forming requires use of a surfactant, which affects both the dry and the wet tensile strength of the sheet negatively. Such tensile strength loss is believed to be due to the surfactants adsorbing to the fibres and thus hindering hydrogen bonding between the fibres.

The foam forming technique has found use particularly in the making of tissue paper. Otherwise the inferior strength properties as compared to standard wet forming, as well as inferior Scott bond and elastic modulus have deterred use of foam forming for other kinds of papermaking. However, WO 2013/160553 teaches manufacture of paper or board, in which microfibrillated cellulose (MFC) is blended with pulp of a higher fibre length and turned to a fibrous web by use of foam forming. Especially a middle layer with an increased bulk is thereby produced for a multilayer board. MFC is purposed to build bridges between longer fibres and thereby lend the resulting paper or board an increased strength. The technique is said to be applicable for folding boxboard and several other paper and board products.

Another approach for utilizing foam in the manufacture of shaped products is described in WO 2015/036659. According to this reference natural and synthetic fibres are turned to an aqueous foamed suspension, which is fed into a mould and dried to a fibrous product such as a three-dimensional package, with a corresponding shape. By feeding different foamed suspensions at multiple steps the mould can be used to make products having a multilayer wall structure.

SUMMARY OF THE INVENTION

The purpose of the present invention is to find a method, which brings an improvement particularly in the making of shaped three-dimensional trays and plates, in which cracking at the folds has been a problem. The solution according to the invention is a method, which is characterized by the steps of (i) providing a fibrous pulp, in which the fibres substantially consist of at least 85 wt-%, preferably 90 to 100 wt-% of softwood fibres having an average fibre length of at least 2.0 mm and at most 15 wt-%, preferably 0 to 10 wt-% of broke having a fibre length of about 0.05 mm to 1.0 mm, (ii) turning the pulp into a foamed suspension, (iii) supplying the foamed suspension from a headbox to a forming fabric of a board machine to form a fibrous web, (iv) drying the web to obtain a dried web having a compressibility in the thickness direction of at least 20% (by application of compression stress of 20 kg/cm$^2$), and, (v) including the web as a layer in a board, which is turned to said tray or plate by thermopressing or deep-drawing.

Generally the fibrous pulp to be foamed may comprise a share of 85 wt-% or more of fresh softwood pulp of a fibre length as described above, blended with a share of at most 15 wt-% of broke of a fibre length as defined above. Preferably the respective shares of the two components to be blended are 88 wt-% and 12 wt-%, more preferably 90 wt-% and 10 wt-%, and most preferably 95 wt-% and 5 wt-%. While the fibrous substance essentially consists of said components, fillers may be added which do not appreciably affect formation.

The inventors have found that for the manufacture of moulded three-dimensional articles intended to be disposed after use the critical parameters are extensibility and compressibility of the fibrous web, provided by its high bulk. Such a material responds to moulding by stretching at the spots of maximal stress without cracking, while being bent to folds to accommodate the surplus material. Surprisingly the desired properties are obtained without use of MFC in the fibrous blend subjected to foam forming. It is sufficient that the pulp has long softwood fibres as its predominant major component, possibly blended with a complementary minor share of broke, which is a by-product (reject) from the preparation of the pulp used for making the board. In case of a multilayer board, which may even include unfoamed high-density (low bulk) layers, the broke usefully contains the rejects from the pulps for each one of those different layers. The shorter fibres comprised in the broke may be included in the foamed high-bulk layer without sacrifying moldability of the finished board, while advantageously no fibrous material is left as waste from the entire process.

Concomitant to improved control of folding at the moulding step the invention allows more secure sealing of a three-dimensional tray along its rim flange as the tray is closed with a heat-sealed lid. The folds extend transversally over the rim flange and must be blocked by melted coating polymer so as to prevent leaks that could contaminate the packaged food product.

In a high-bulk web produced by foam formation according to the invention the Ambertec normalized formation may be below 0.8 g/m^0.5, preferably below 0.6 g/m^0.5 and at best below 0.45 g/m^0.5. The bulk of the dried web may be in a range of 2.5 $cm^3$ to 7 $cm^3$.

In usual wet forming on a forming fabric the fibres orient in the plane of the fabric or the emerging web, in machine and cross-machine directions (x-y orientation). However, in foam forming there is fibre orientation even in the vertical (z) direction, producing a porous high-bulk structure with increased compressibility. By maximizing the share of long softwood fibres an increased bulk and maximal compressibility are achieved and compression forces are distributed more evenly, resulting in better controlled generation of wrinkles.

A particular advantage of the invention is that existing board machines adapted for foam forming can be used, without further adjusting. Production of the board and turning it to trays or plates can be brought into practice cost-efficiently.

According to an embodiment of the invention at least 95 wt-% of the fibres used for the foam formed layer are softwood fibres of an average fibre length of 2.0 mm or more. The share of such long softwood fibres being from 95 to 100 wt-%, the rest, 0 to 5 wt-% will be broke of fibre length of at most 1.0 mm.

According to another embodiment of the invention the softwood fibres are fractionated so as to reduce the share of fibers having a length of less than 2.0 mm.

The softwood fibres used in the invention may be fibres of pine (*Pinus*), spruce (*Picea*) or Douglas fir.

The broke may even comprise hardwood fibres. This is the case especially when the board is a multilayer board with layers of higher density (lower bulk) made partially or completely of hardwood, such as fibres of birch (*Betula*).

The foamed suspension supplied to the forming fabric may have a fibre consistency within a range from 0.65% to 2.5%. This is well above consistencies of about 0.35% to 0.60% as usually applied in papermaking. For paperboard and cardboard obtaining a good formation would require addition of short fibres, which has the drawback of weakened tear strength. However, by applying foam formation the consistency can be raised while the share of long fibres of 2.0 mm or more is increased up to 90 wt-% or more, without sacrifying good formation on the fabric. The resulting high-bulk web then stands shaping into trays or like 3D articles without damage at the spots of maximal stress.

For example sodium dodecyl sulphate (SDS) can be used as the surfactant producing the foam. Suitable amount of surfactant in the foamed pulp supplied from the headbox is 10 to 100 ppm by weight.

The invention may be used in the production of trays or plates of a single layer as well as of a multilayer material such as paperboard or cardboard. Preferably a web is made by foam forming as described above and positioned as a middle layer of a multilayer board, while outer surface layers on both sides of the middle layer are produced by usual water forming from non-foamed fibrous pulp. In this connection the broke used for the middle layer may include fibrous rejects from the production of the outer surface layers.

According to an embodiment of the invention the softwood pulp used for the middle layer is CTMP and the pulp for the outer surface layers is chemical pulp or CTMP of hardwood or a blend of hardwood and softwood. In this case the broke included in the middle layer may comprise a mixture of softwood CTMP and hardwood cellulose or CTMP, i.e. rejects from the pulps for each layer.

The invention covers the shaped trays and plates of fibrous material, which are obtained by use of the method as described in the above.

The thermopressing or deep-drawing step for shaping the tray or plate forces the material to folds or wrinkles at the corners or along the periphery of the shaped article. If desired, the material can be provided with premade score lines to determine the location of the folds. By use of the foam-forming technique the fibrous layer allows at the spot of the score lines compression of at least 20% in the thickness direction.

EXAMPLE

For the production of trays a triple-layer board was produced, comprising a middle layer of a weight of 180 $g/m^2$ sandwiched between two outer layers of a weight of 60 $g/m^2$, the board thus having a total weight of 300 $g/m^2$. The fibrous material for the outer layers was a virgin chemical pulp blend of 60 wt-% of birch (hardwood) and 40 wt-% of pine (softwood). The fibrous material for the middle layer was a blend of 90 wt-% of virgin pine (softwood) CTMP and 10 wt-% of broke derived from the preparation of the fibrous material blends for each one of the three layers. The broke thus had a share of about 25 wt-% of hardwood. The pine CTMP for the middle layer had an average fibre length above 2.0 mm, while the fibre length of the broke was generally less than 1.0 mm.

For the middle layer a furnish was made by mixing (i) 90 wt-% of pine CTMP and (ii) 10 wt-% of broke, which comprised the rejects from the preparation of said pine CTMP as well as rejects from preparation of chemical pulps of birch (60%) and pine (40%) for making the two outer layers. Water was added to achieve a fibre consistency of about 2% (not including eventual fillers). Sodium dodecyl sulphate (SDS) as a surface active agent was added to the furnish to turn it into a foam having an air content of 60-70% and content of SDS about 50 ppm. The foam was immediately supplied from a headbox to a forming fabric of a board machine. A foam formed web was thus produced, dewatered by suction through the forming fabric, and dried in known manner. The resulting dried web had a bulk of about 5 $cm^3/g$ and a weight of 180 $g/m^2$.

For the outer layers webs were formed by mixing 60 wt-% of birch cellulose and 40 wt-% of pine cellulose (kraft pulp), turning this mixture to an aqueous furnish, and making the webs by use of standard wet-forming technique in a board machine. The high-bulk webs thus obtained had a weight of of 60 $g/m^2$. The three webs were combined in the board machine to form the finished triple-layer board product.

To produce a tray a rectangular piece of the board was provided by score lines pressed to its four corners to determine the location of the folds, and then thermoformed to a rectangular tray of a depth of 2.5 cm at a temperature of about 80° C. and moisture content of about 13%. The finished tray had folds in the corners, which had formed without cracks or other damage.

The invention claimed is:

1. A method of manufacturing a shaped tray or plate of fibrous material, comprising the steps of:

foam forming a web consisting of the steps of providing a fibrous pulp, in which the fibres consist of at least 85 wt-% of softwood fibres having an average fibre length of at least 2.0 mm and at most 15 wt-% of broke having a fibre length of about 0.05 mm to 1.0 mm, adding a surface active agent to the pulp and turning the pulp into a foamed suspension, supplying the foamed suspension from a headbox to a forming fabric of a board machine to form a fibrous web, and dewatering and/or drying the web to obtain a dried web having a compressibility in the thickness direction of at least 20%, and, including the web, consiting of the dried web formed by the dewatering and/or drying step, as a layer in a board, which is turned to said tray or plate by thermopressing or deep-drawing.

2. The method of claim 1, wherein 90 to 100 wt-% of the fibres of the fibrous pulp are said softwood fibres, the share of said broke being 0 to 10 wt-%.

3. The method of claim 1, wherein the softwood fibres are fractionated so as to reduce a share of the softwood fibers having a length of less than 2.0 mm.

4. The method of claim 1, wherein the softwood fibres consist of fibres selected from the group of pine (*Pinus*), spruce (*Picea*) or Douglas fir.

5. The method of claim 1, wherein said broke comprises hardwood fibres.

6. The method of any one of claim 1, wherein the foamed suspension supplied to the forming fabric has a fibre consistency in a range of 0.65% to 2.5%.

7. The method of claim 1, wherein said web made by foam forming is positioned as a middle layer of a multilayer board, while outer surface layers on both sides of said middle layer are produced from unfoamed fibrous pulp.

8. The method of claim 7, wherein said broke used for the middle layer comprises rejects from the production of said outer surface layers.

9. The method of claim 7, wherein the softwood pulp used for the middle layer is CTMP and the pulp for the outer surface layers is chemical pulp or CTMP of hardwood.

10. A method of manufacturing a shaped tray or plate of fibrous material, comprising the steps of:

foam forming a web consisting of the steps of providing a fibrous pulp, in which at least 85 wt-% of the fibers are softwood fibres having an average fibre length of at least 2.0 mm and from 5 to 15 wt-% of broke having a fibre length of about 0.05 mm to 1.0 mm, turning the pulp into a foamed suspension, supplying the foamed suspension from a headbox to a forming fabric of a board machine to form a fibrous web, drying the web to obtain a dried web having a compressibility in the thickness direction of at least 20%, including the web, consisting of the dried web from the drying step, as a middle layer of a multilayer board, while outer surface layers on both sides of said middle layer are produced from unfoamed fibrous pulp, and thermopressing or deep-drawing the multilayer board to form said tray or plate.

11. A shaped tray or plate of fibrous material manufactured by the method comprising the steps of:

foam forming a web consisting of the steps of providing a fibrous pulp, in which the fibres consist of at least 85 wt-% of softwood fibres having an average fibre length of at least 2.0 mm and at most 15 wt-% of broke having a fibre length of about 0.05 mm to 1.0 mm, turning the pulp into a foamed suspension, supplying the foamed suspension from a headbox to a forming fabric of a board machine to form a fibrous web, dewatering and/or drying the web to obtain a dried web having a compressibility in the thickness direction of at least 20%, and including the web, consisting of the dried web from the dewatering and/or drying step, as a layer in a board, which is turned to said tray or plate by thermopressing or deep-drawing.

12. The shaped tray or plate of claim 11, wherein it has folds, in which the layer has been compressed at least 20% in the thickness direction.

* * * * *